US010919319B2

(12) United States Patent
Boniface et al.

(10) Patent No.: US 10,919,319 B2
(45) Date of Patent: Feb. 16, 2021

(54) PRINTING AND DRYING INSTALLATION AND PRINTING AND DRYING METHOD

(71) Applicant: SMRC AUTOMOTIVE HOLDINGS NETHERLANDS B.V., Amsterdam (NL)

(72) Inventors: Jérôme Boniface, Santes (FR); Romuald Richebourg, Carvin (FR); Marc Saelen, Allennes-les-Marais (FR)

(73) Assignee: SMRC AUTOMOTIVE HOLDINGS NETHERLANDS B.V.

( * ) Notice: Subject to any disclaimer, the term of this patent is extended or adjusted under 35 U.S.C. 154(b) by 34 days.

(21) Appl. No.: 16/477,074

(22) PCT Filed: Jan. 5, 2018

(86) PCT No.: PCT/EP2018/050224

§ 371 (c)(1),
(2) Date: Jul. 10, 2019

(87) PCT Pub. No.: WO2018/130458

PCT Pub. Date: Jul. 19, 2018

(65) Prior Publication Data

US 2019/0337306 A1 Nov. 7, 2019

(30) Foreign Application Priority Data

Jan. 12, 2017 (FR) ..... 1750260

(51) Int. Cl.
*B41J 11/00* (2006.01)
*B41J 3/407* (2006.01)
(Continued)

(52) U.S. Cl.
CPC ..... *B41J 11/002* (2013.01); *B41J 3/4073* (2013.01); *B41M 5/0088* (2013.01); *B41M 7/0081* (2013.01)

(58) Field of Classification Search
CPC ..... B41J 11/002; B41J 3/4073; B41J 11/00; B41J 11/0015; B41J 2/2114; B41M 5/0088; B41M 7/0081
See application file for complete search history.

(56) References Cited

U.S. PATENT DOCUMENTS

2011/0149000 A1* 6/2011 Albertalli ..... B41J 25/001 347/89
2015/0116413 A1* 4/2015 Duke ..... B41J 29/393 347/19

(Continued)

FOREIGN PATENT DOCUMENTS

EP 1162079 A2 12/2001
FR 2862563 A1 5/2005

(Continued)

OTHER PUBLICATIONS

Written Opinion of International Searching Authority and International Searching Report for International Application No. PCT/EP2018/050224; dated Mar. 22, 2018; 11 pages; English Translation of International Searching Report Included.

(Continued)

*Primary Examiner* — Kristal Feggins
(74) *Attorney, Agent, or Firm* — Dickinson Wright PLLC

(57) ABSTRACT

The present invention concerns an installation for printing and drying a part having a surface. The installation includes a printing means comprising a printhead, a control unit, a support device suitable and intended for supporting the part, the support device and printhead being movable relative to each other, drying means including a source and an emission output, the emission output and support device being movable relative to each other, and means for adjusting and orienting the beam specifically associated with the source and/or with emission output.

17 Claims, 11 Drawing Sheets

(51) Int. Cl.
*B41M 5/00* (2006.01)
*B41M 7/00* (2006.01)

(56) References Cited

U.S. PATENT DOCUMENTS

| | | | | |
|---|---|---|---|---|
| 2015/0231897 | A1 | 8/2015 | Noell | |
| 2019/0160539 | A1* | 5/2019 | Lei | B29C 64/268 |
| 2020/0023658 | A1* | 1/2020 | Ko | B41J 25/3086 |

FOREIGN PATENT DOCUMENTS

| | | | |
|---|---|---|---|
| FR | 3033506 | A1 | 9/2016 |
| WO | 2015177598 | A1 | 11/2015 |

OTHER PUBLICATIONS

International Preliminary Report on Patentability for International Application No. PCT/EP2018/050224; dated Apr. 18, 2018; 7 pages.

* cited by examiner

PRINTING AND DRYING INSTALLATION AND PRINTING AND DRYING METHOD

CROSS-REFERENCE TO RELATED APPLICATIONS

This application claims the benefit of PCT/EP2018/050224 filed Jan. 5, 2018, which claims the benefit of French Patent Application No. 1750260 filed Jan. 12, 2017, which is incorporated herein by reference in its entirety.

FIELD

The present invention relates to the field of printing and drying of parts, in particular trim pieces or upholstery for vehicle interiors, and relates to an installation for printing and drying of at least one part and a method for printing and drying of at least one part.

BACKGROUND

We already know from publication FR 3033506 A1 by the Applicant, about a method and an installation for embossing a part, comprising printing means provided with one or more inkjet-type printheads, and a device for supporting a part. The support device and the printing means can be moved relative to one another in a controlled manner. In addition, drying means can be provided for drying or crosslinking the ink deposited by the printing means. However, the drying operation has the disadvantage of not being optimized for all types of devices.

Publication WO 2015/177598 A1 discloses a three-dimensional layer-by-layer printing system for printing on outer surfaces of a plurality of substrate elements which passes through a printing area while being rotated inside thereof around a printing axis. The system includes printheads and the printing area corresponds to a linear segment of a closed-loop conveying path along which the objects advance. The system also includes a drying unit located along the conveying direction. However, in such a system the printing and drying steps take place successively and with a lag time between these two stages, which has the disadvantage of slowing the rate of printing.

The publication FR 2 862 563 A1 discloses a three-dimensional printing robot on a fixed surface comprising an inkjet printing assembly, a drying device, displacement and orientation means according to several axes of this printing set and this drying device and a control unit of these means. Such a printing robot has the disadvantage of being adapted only to fixed and flat surfaces and not be usable for devices having any shape and/or complex or small radii of curvature.

Uniform drying cannot be guaranteed, because the surface of the part may be too far from the drying means when moving the printing system relative to the part due to the shapes of its geometry, especially for parts having radii of curvature less than 100 millimeters. In addition, the drying device has the disadvantage of being bulky, heavy and complex.

Publication US 2015/02311897 A1 discloses an apparatus for printing and drying the curved surface of an object which includes a printing unit, a drying unit, and a movement unit such as a robot allowing for simultaneously moving the printing unit and the drying unit at a working distance along the surface or moving the object at a working distance along the printing unit and the drying unit. The drying unit comprises either a UV lamp or UV LEDs. This installation has the disadvantage of not guaranteeing uniform drying for parts having complex shapes and require a protection plate to prevent the beam from the drying unit from diffusing towards the printing unit.

SUMMARY

The goal of the present invention is to propose a solution that guarantees a uniform, optimized, fast drying, to overcome the main disadvantages of the known aforementioned solutions and overcome their major limitations.

For this purpose, the subject matter of the invention is an installation for printing and drying at least one part comprising at least one surface to be printed, installation comprising at least:

printing means comprising at least one printhead, preferentially of the inkjet type to form a printed surface on a part, at least one base or pedestal on which is mounted at least one printhead, a control unit, a support device that is suitable and intended to support the device, the support device and at least one printhead being relatively movable relative to one another, means of drying and/or controlled crosslinking comprising at least one radiation source and at least one emission output from which emanates at least one ray beam, at least one emission output and said support device being relatively movable relative to one another, the relative displacements between the device support device(s), on the one hand, and at least one printhead and/or, on the other hand, at least one emission output, the means for drying and/or controlled crosslinking being piloted preferably by the control unit, the installation characterized in that it comprises means for adjusting the orientation of the beam specifically associated with at least one source and/or at least one emission output.

The invention also relates to a method for printing and drying at least one part comprising at least one surface to be printed, characterized in that it implements the installation described above and that it comprises at least successively:

a printing step, during which: a liquid substance is deposited by the printhead of the printing means on the printing surface of the part and the part is moved in a controlled manner by the support device in front of the printhead to form a printed surface, and eventually after lapsing of a determined time interval, a drying step, during which: the deposited liquid substance is reached by a beam of rays emitted by the means for drying and/or controlled crosslinking to be dried, the part is moved by the support device, a preset distance between the emission output of the means for drying and/or controlled crosslinking and the printed surface of the part is maintained, preferably between 10 and 50 millimeters, and the beam is oriented by the beam orientation adjusting means specifically associated with the radiation source and/or at least one emission output.

BRIEF DESCRIPTION OF THE DRAWINGS

The invention will be better understood, thanks to the following description, which relates to several favorite embodiments, given as non-limiting examples, and explained with reference to the accompanying schematic drawings, in which.

DETAILED DESCRIPTION

Figure 1A:
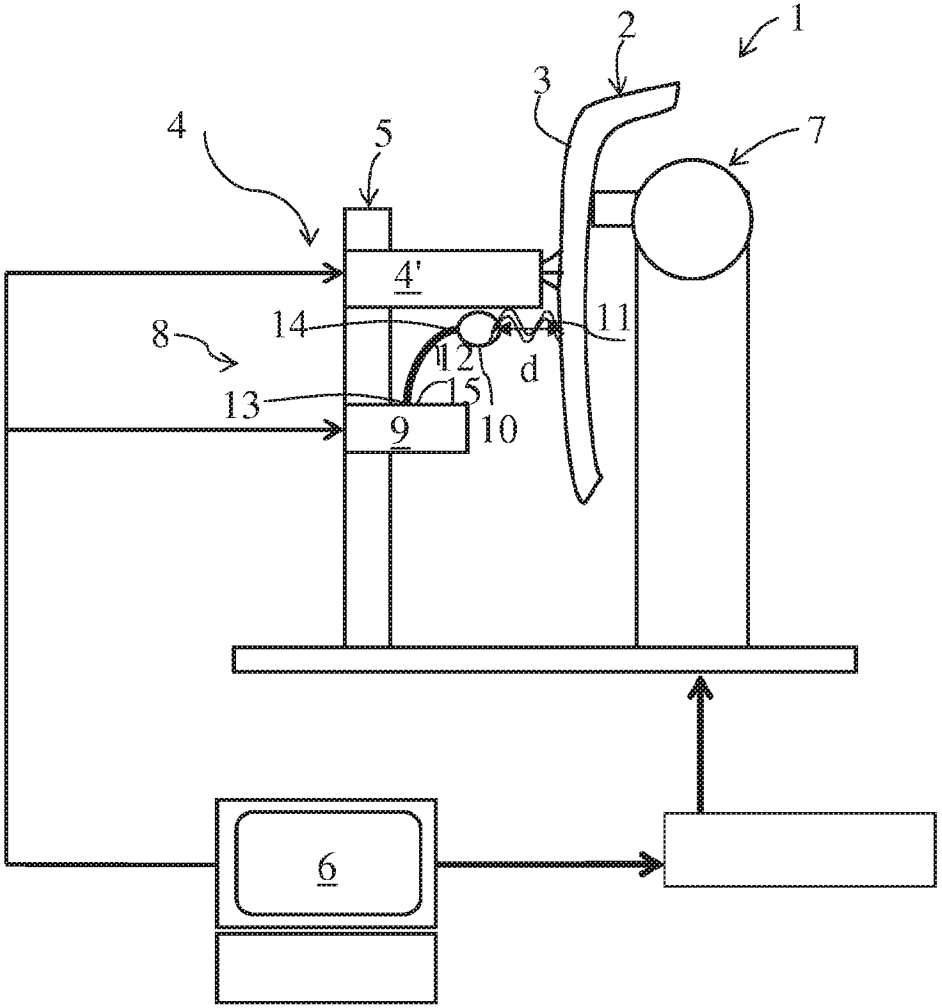
FIG. 1A is a schematic view of an installation according to the invention in a first embodiment variant.

The installation 1 for printing and drying at least one part 2 comprising at least one surface 3 to be printed comprises at least:

printing means 4 comprising at least one printhead 4', preferentially of the inkjet type for depositing at least one liquid substance and forming a surface 3 printed on part 2, at least one base 5 or a pedestal on which is mounted at least one printhead 4', a control unit 6, a support device 7 which is suitable and intended to support the part 2, the support device 7 and at least one printhead 4' being relatively movable relative to each other, controlled drying and/or crosslinking means 8 comprising at least one radiation source 9 and at least one emission output from which emanates at least one ray beam 11, at least one emission output and said support device 7 being relatively movable relative to each other, the relative displacements between the support device 7 of part(s) 2, on the one hand, and at least one printhead 4' and/or, on the other hand, at least one emission outlet of the drying and/or controlled crosslinking means 8 being preferably driven by the control unit 6.

These relative displacements can alternatively be controlled by a servo system, or by permanent movement back and forth.

The liquid substance may be ink, for example ink for an inkjet printer, or a colored substance or not, possibly transparent, which can be applied by such a printer. The ink can be a UV ink.

According to the invention, the installation 1 is characterized in that it comprises means for adjusting the orientation of the beam 11 specifically associated with at least one source 9 and/or at least one emission output.

By means of adjusting the orientation of the beam 11 specifically associated with at least one source 9 and/or at least one emission output, we mean that the means for adjusting the orientation of the beam 11 act solely on the orientation of the source 9 and/or of the emission output. Such means for adjusting the orientation of the beam 11 do not act on the orientation of the printing means 4 and in particular the printhead 4'.

Advantageously, the orientation of at least one source 9 and/or at least one emission output is independent of the orientation of the printing means 4 and in particular of the printhead 4'.

Advantageously, the means for adjusting the orientation of the beam 11 allow the beam 11 to be oriented so that it continuously reaches the surface 3 that has just been printed.

This results in uniform drying of the liquid substance after printing. Indeed, the liquid substance deposited on the surface 3 of the part 2 by the printhead 4' can be dried directly and uniformly by the means for drying and/or controlled crosslinking 8 after its deposition, in a controlled manner. Advantageously, when the liquid substance is deposited in the form of drops, such a configuration makes it possible to control the quality of the drops. This prevents the drops of liquid substance from flowing or sliding by gravity. Even drying of the liquid substance deposited on the surface 3 of the part 2 after printing can also be guaranteed regardless of the shape of the part 2. In particular, such a configuration makes it possible to dry both parts 2 having a generally flat overall appearance or with a large radius of curvature, that is to say a radius of curvature greater than 100 millimeters, as well as parts having any shape and/or complex or small radii of curvature, that is, less than 100 millimeters, or circular in shape.

Preferably, the support device 7 can be mobile under the control of the control unit 6 with respect to printhead 4' which can be fixed and/or at the source 9 and/or at the emission output, by presenting preferentially a robotic multiaxis structure.

Thus, the printhead 4' can be fixed with respect to the source 9 and/or the emission output and the part 2 can be moved in front of the latter by the support device 7 which can be movable.

The support device 7 used may consist of a robotic arm comprising six axes of rotation.

Advantageously, this robotic arm makes it possible to move the part 2 in front of at least one printhead 4' and/or at least one emission output of the drying and/or controlled cross-linking means 8.

The axes of rotation, as well as the movement of the robotic arm, are not fixed and totally free. This results in a large latitude of movement of the robotic arm depending on the geometry of the part 2.

As illustrated in the figures, the printhead 4' and the source 9 can be arranged on the same base 5.

The printhead 4' can preferably be fixed on the base 5 as illustrated in all the figures. Moreover, the source 9 can be fixed on the base 5 (FIG. 1A to 3B) or it can be mounted swiveling relative to the base 5 (FIGS. 4A to 4B).

Preferably, the source 9 of radiation may be a source of light radiation generating at least one beam 11 having wavelengths, preferably in majority, in the ultraviolet field. For example, the source of light radiation 9 may be an ultraviolet lamp, or one or more LEDs, the latter having the advantage of being compact and robust.

According to the first, second and third embodiments of the invention, the drying and/or controlled cross-linking means 8 may comprise at least one optical waveguide 12, 12' comprising at least one input of the waveguide 13 and at least one output of the waveguide 14, said input of the waveguide 13 being coupled to an output of the source 15, and said output of the waveguide 14 or a deflector 10, 10' mounted on the output of the waveguide 14 or a beam 11 downstream of said output of the waveguide 14 or the deflector 11 forming an emission output of drying and/or crosslinking means 8, and a preset distance between the emission output and the printhead 4' may preferably be between 30 and 100 millimeters (FIGS. 1A to 3B).

This configuration advantageously makes it possible on the one hand to move the source 9 away from the printhead 4', the source 9 generally having the disadvantage of being bulky, and bringing the emission output near the printhead 4', in order to conduct the light radiation of the beam 11 near the printhead 4'.

Figure 1B:
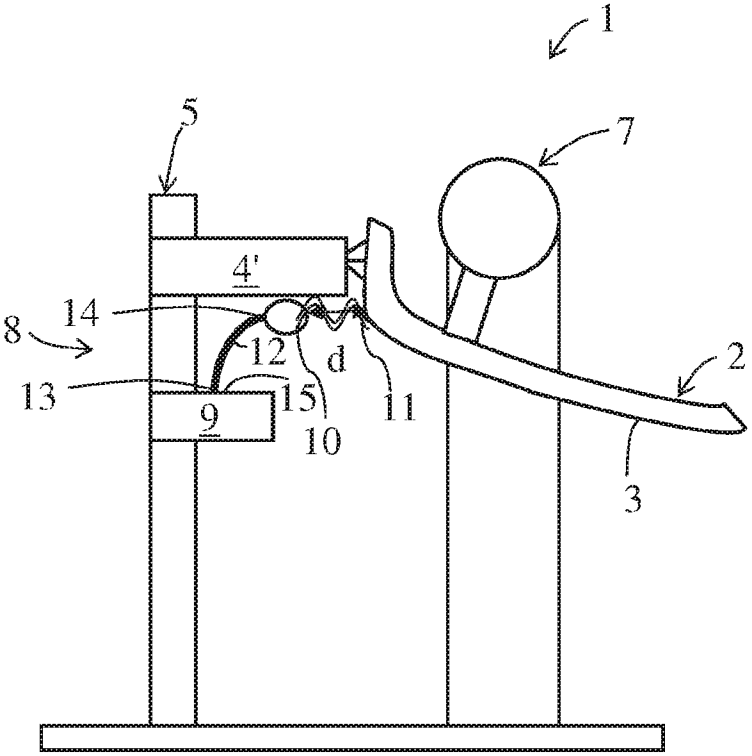
FIG. 1B is a partial schematic view of the installation of FIG. 1A during the displacement of the part.
Figure 1D:
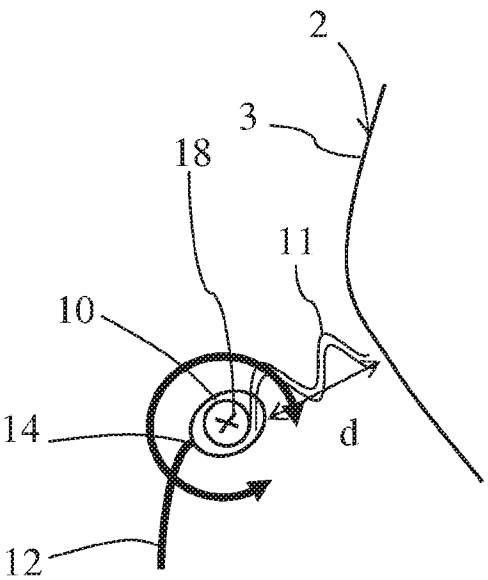
FIG. 1D is a detailed schematic view of the installation represented in FIG. 1B.
Figure 1C:
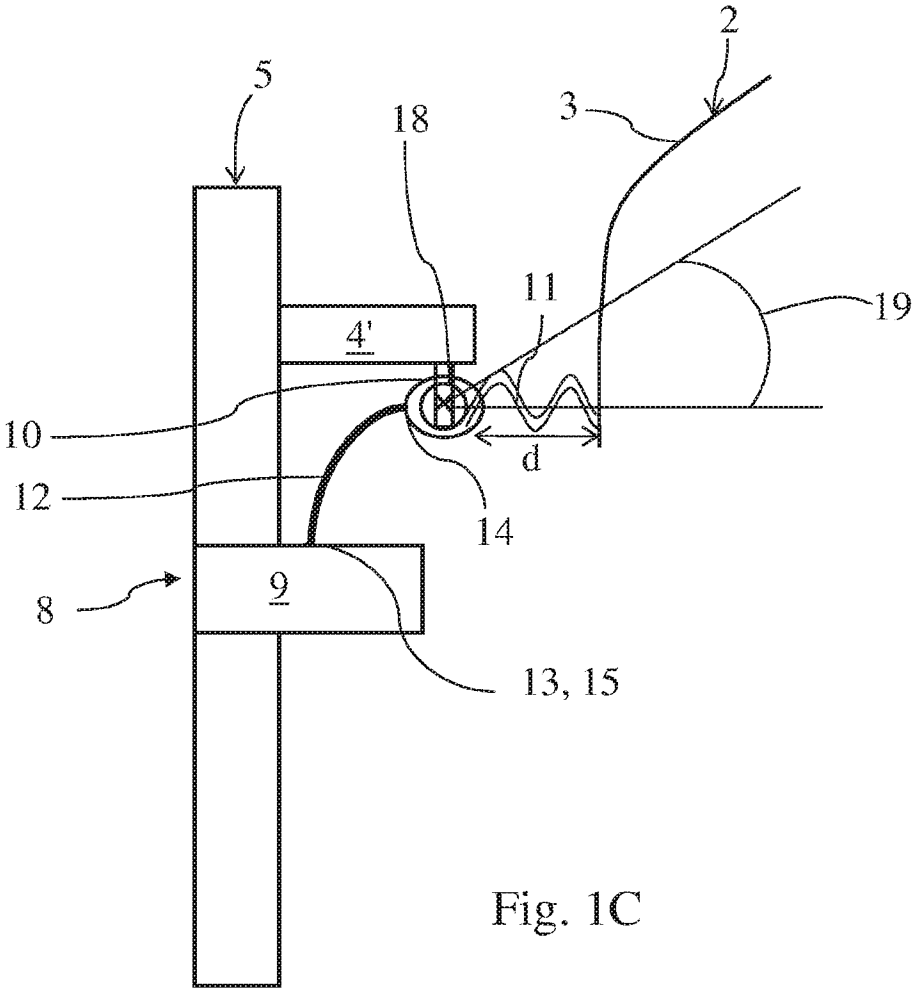
FIG. 1C is a partial schematic and detailed view of the installation represented in FIG. 1A.

In the first embodiment variant, the means of drying and/or controlled crosslinking 8 may comprise a single waveguide 12 and the means for adjusting the orientation of the beam 11 may comprise an axis of rotation 18 which can be rotated by a predetermined angle 19 controlled by the control unit 6 specifically associated with the emission output, (FIGS. 1A to 1C).

In this configuration, the surface 3 of the part 2 is continually facing the emission output. Such a configuration has the advantage of minimizing congestion near the printhead 4', of bringing the emission output closer to the printhead 4' and of maintaining a minimum distance d between the newly printed surface 3 and the single emission output which can be between 10 and 30 millimeters. As a result, the drying of the liquid substance deposited on the surface 3 of the part 2 is carried out as close as possible to the part 2 and directly or immediately after the deposition of the liquid substance by the printhead 4'. Indeed, in this configuration, it is possible to prevent the surface 3 of the part 2 from being either too far from the emission output or not facing the emission output which impacts the quality and the uniformity of drying.

In this first embodiment variant, the output of the waveguide 14 or a deflector 10 can form the emission output.

Preferably, the angle 19 can be between 0 and 45 degrees. The angle 19 is 0 degrees when the beam 11 is substantially horizontal.

According to this first embodiment variant, the emission output can be formed by the deflector 10 mounted on the output of the waveguide 14 (FIGS. 1A to 1D). In addition, the emission output can advantageously be mobile in particular in rotation, for example, when the deflector 10 is mounted on the axis of rotation 18.

Figure 5B:
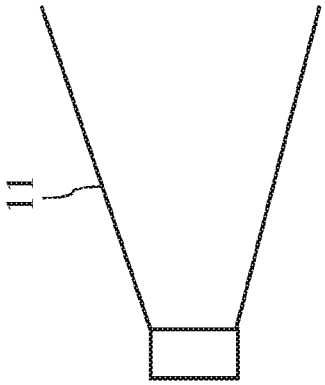
FIG. 5B illustrates the shape of the beam without a deflector.
Figure 5C:
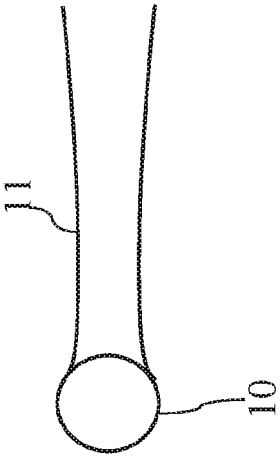
FIG. 5C illustrates the shape of the beam with a deflector.
Figure 5A:
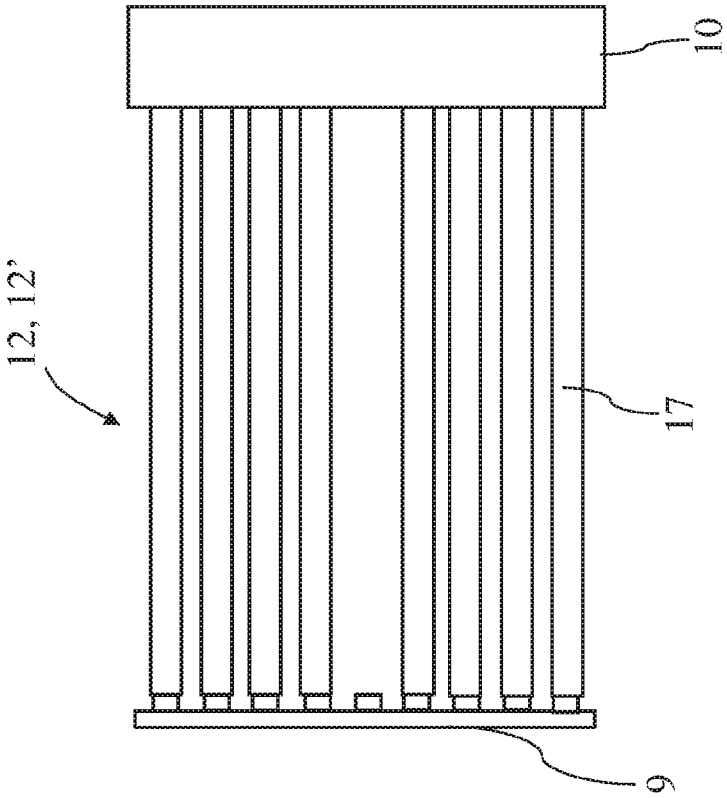
FIG. 5A is a side view of a waveguide comprising a plurality of optical fibers.

However, this example is not limiting. The deflector 10 allows the beam to be concentrated at a precise location or area for greater drying efficiency (FIGS. 5B and 5C). Preferably, the deflector 10 may have a cylindrical or rectangular shape.

Figure 2A:
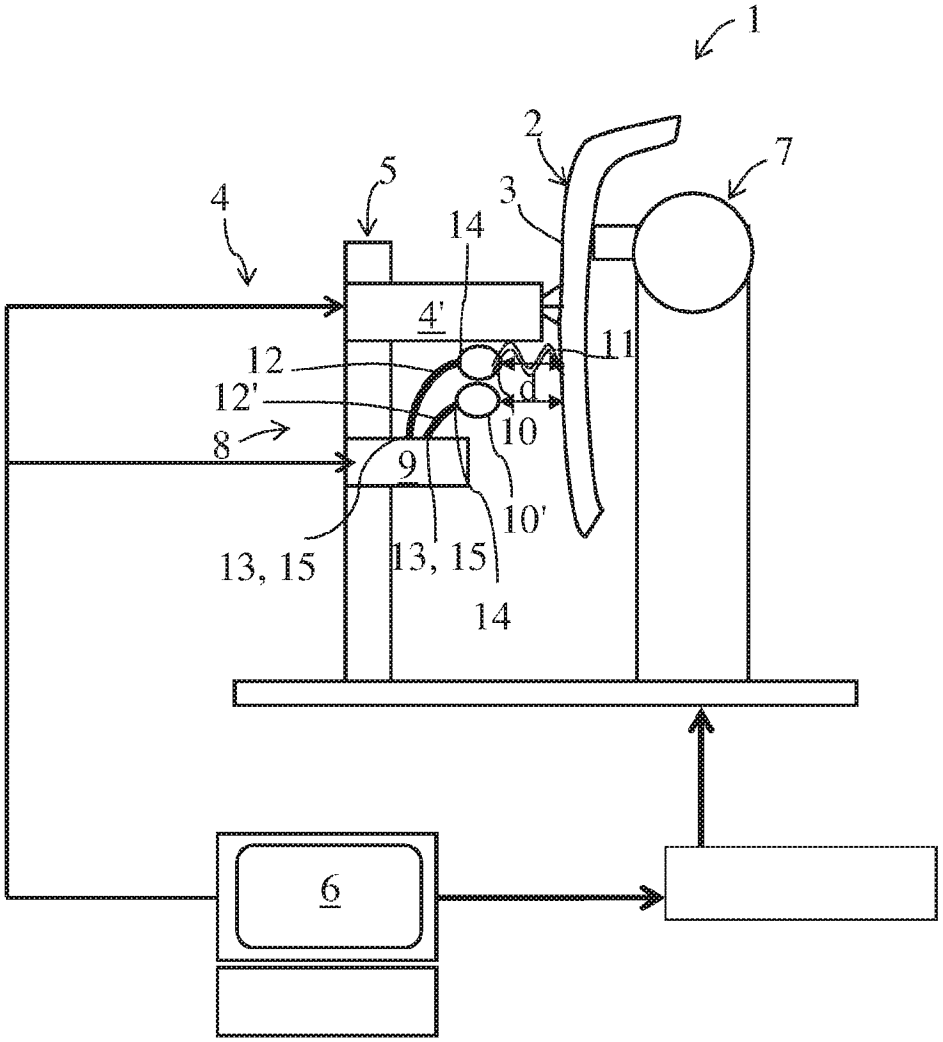
FIG. 2A is a schematic view of an installation according to the invention in a second embodiment variant.
Figure 2B:
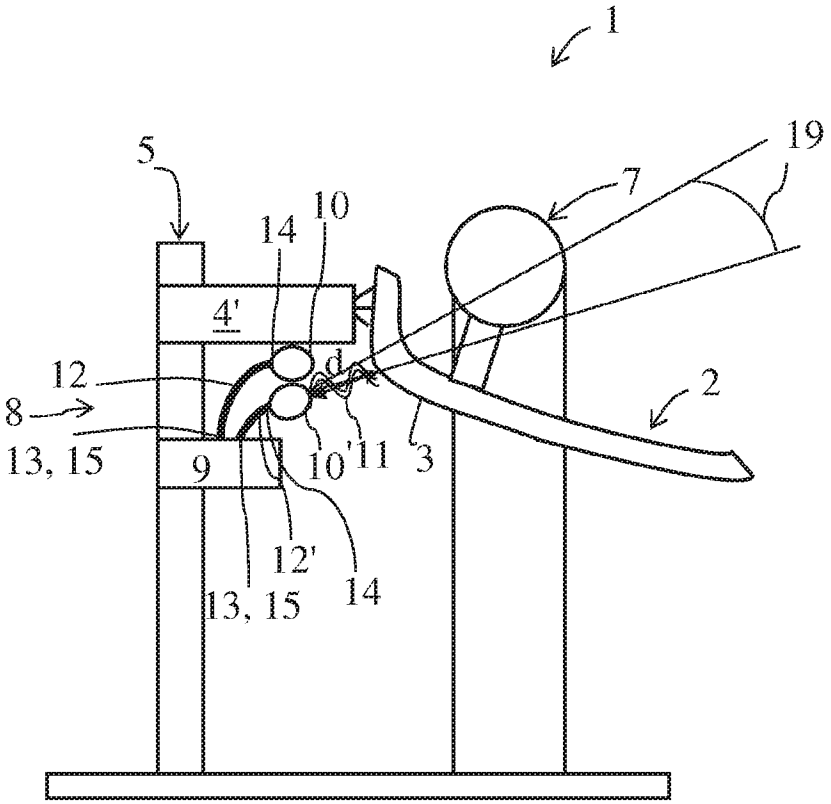
FIG. 2B is a partial schematic view of the installation in FIG. 2A during the displacement of the part and after orientation of a waveguide.
Figure 2D:
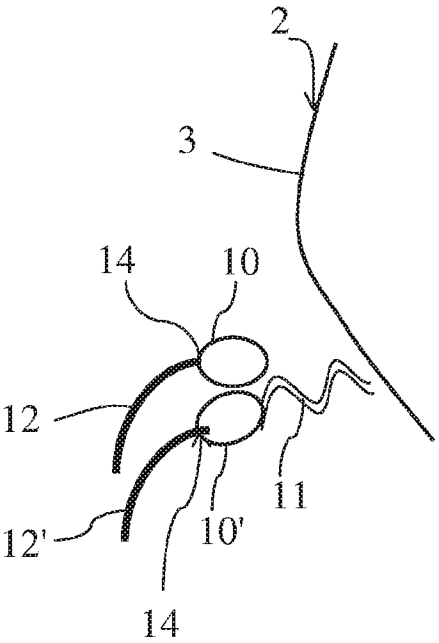
FIG. 2D is a detailed schematic view of the installation shown in FIG. 2C during the displacement of the part.
Figure 2C:
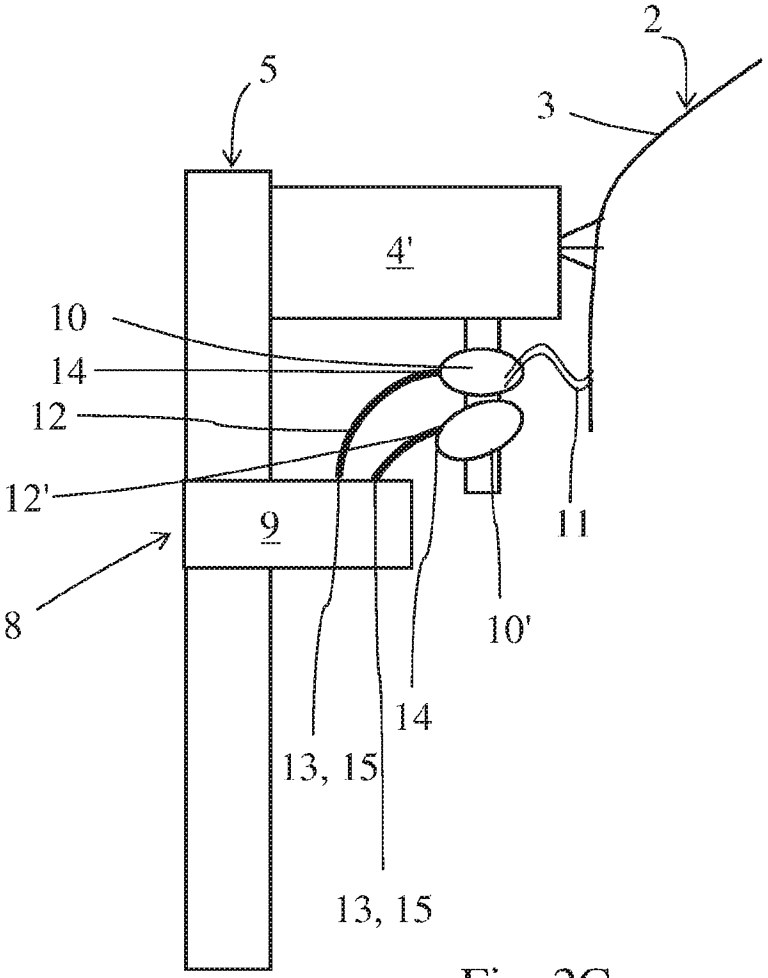
FIG. 2C is a partial schematic view of the installation shown in FIG. 2A after orientation of a waveguide.

In the second embodiment variant, the drying and/or controlled cross-linking means 8 can comprise a plurality of waveguides 12, 12' and the means for adjusting the orientation of the beam 11 comprise a plurality of rotation axes pre-oriented at a predetermined angle 19 specifically associated with the emission outputs (FIGS. 2A and 2B).

Advantageously, the surface 3 just printed is continuously facing the emission outputs. The sources 9 can be used successively. The advantage of this configuration lies in the simplicity of development because no programming of a control unit is necessary depending on the kinematics of the part 2.

In this second embodiment variant, the output of the waveguide 14 or a deflector 10, 10' can form the emission output.

Preferably, the angle 19 may be between 30 and 60 degree

According to this second embodiment variant, the emission outputs can be formed by each deflector 10, 10' mounted on each output of the waveguide 14 (FIGS. 2A to 2D). In addition, the emission outputs can advantageously be mobile in particular in rotation, for example, when the deflector 10, 10' is mounted on their respective axis of rotation.

Figure 3A:
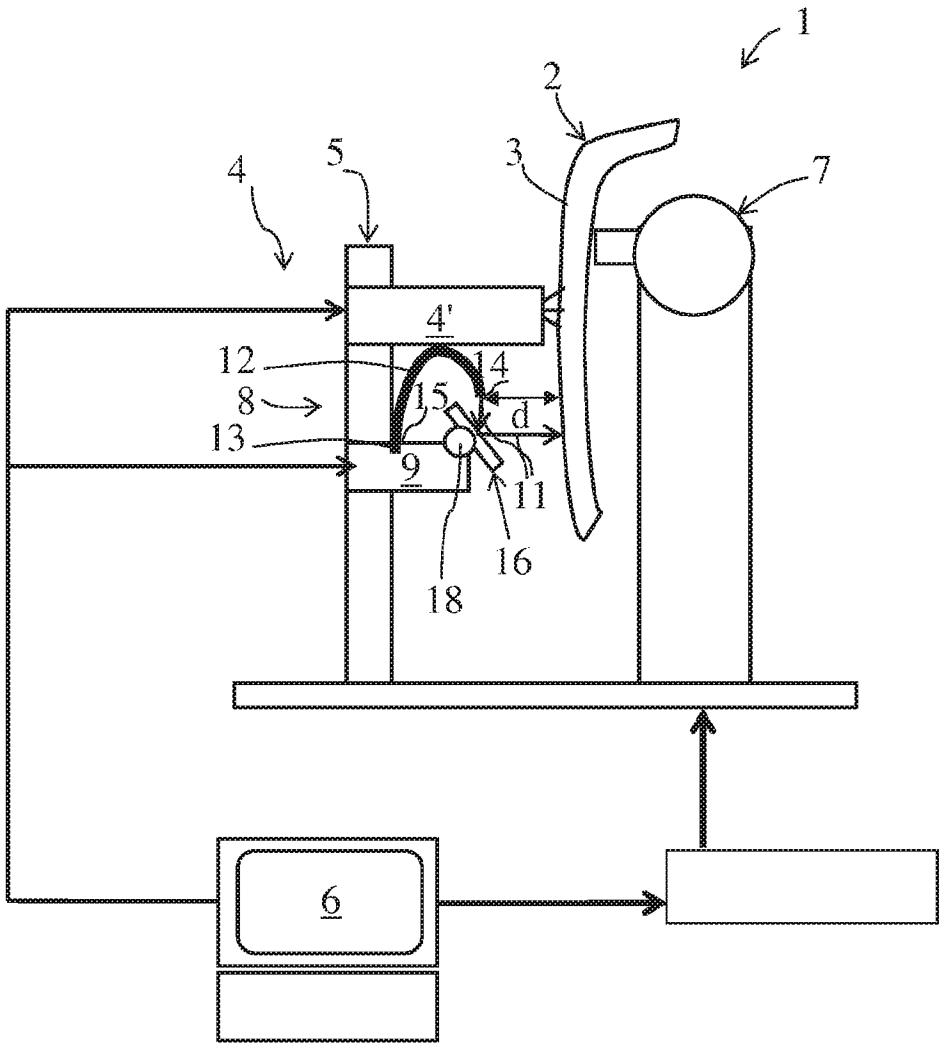
FIG. 3A is a schematic view of an installation according to the invention in a third embodiment variant.
Figure 3C:
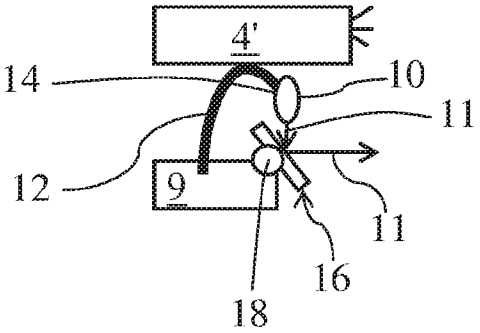
FIG. 3C is a schematic view of an installation according to the invention in the third embodiment variant with a waveguide provided with a deflector.
Figure 4A:
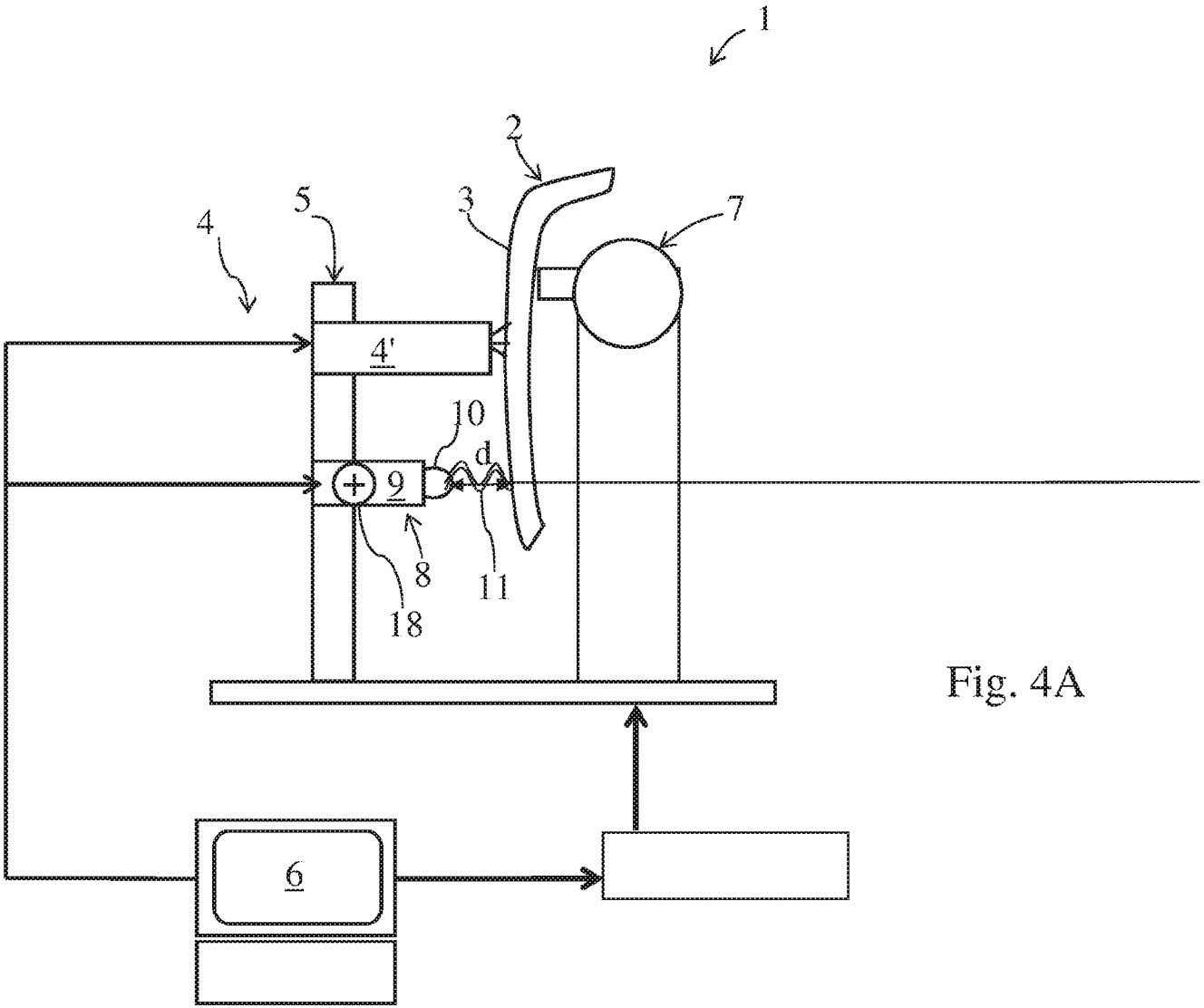
FIG. 4A is a schematic view of an installation according to the invention in a fourth embodiment variant.
Figure 4B:
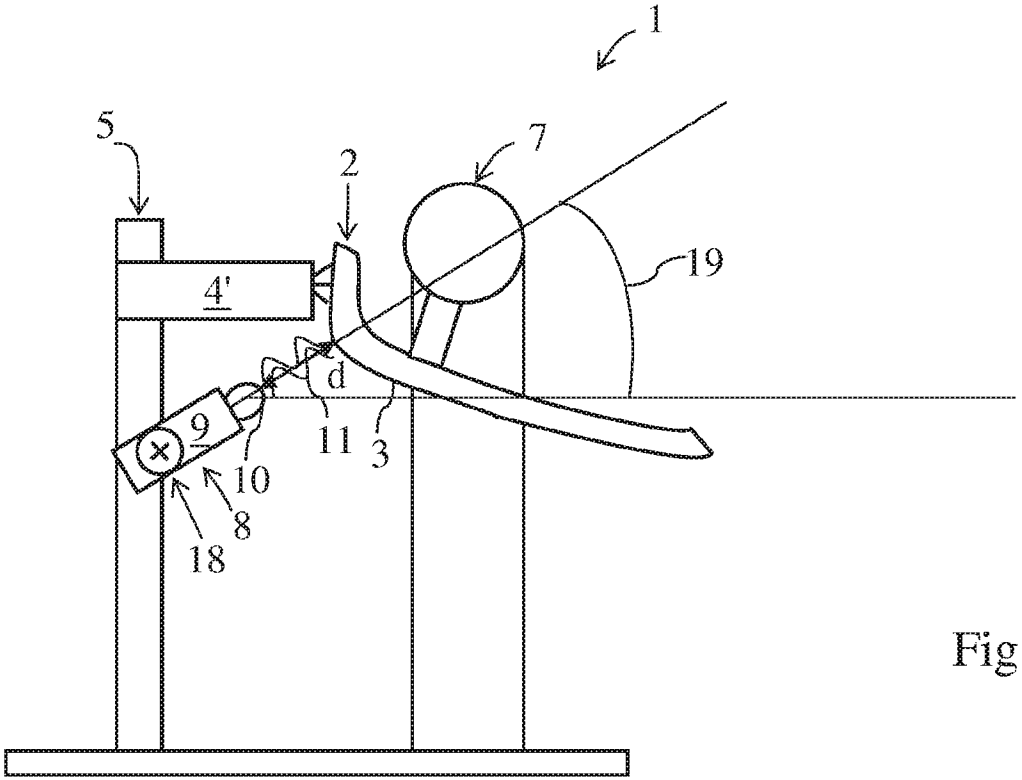
FIG. 4B is a partial schematic view of the installation in FIG. 4A during the displacement of the part.

In the third embodiment variant, the means of drying and/or controlled crosslinking 8 may comprise a single waveguide 12 and the means for adjusting the orientation of the beam 11 may comprise deflection means 16 of the beam 11 which may be arranged downstream or after the exit of the waveguide 14 to orient the ray beam 11 at a predetermined angle 19 (FIGS. 3A and 3C). Advantageously, this arrangement makes it possible to orient the beam 11 in such a way that the latter reaches continuously the surface 3 that has just been printed and that must be dried, without moving either the waveguide 12 or the source 9.

Preferably, only the deflection means 16 can be mobile and the output of the waveguide 14 can be fixed.

In this case, the deflection means 16 can be rotatably mounted on an axis of rotation 18 controlled by the control unit 6. The orientation of the deflection means 16 can thus be automated and controlled by the control unit 6. In this third embodiment, the deflection means and the axis of rotation 18 can be mounted on the source 9.

Preferably, the deflection means 16 may be chosen from at least one prism (not shown) or at least one mirror (FIGS. 3A and 3B) or at least one semi-reflecting element (not shown).

Figure 3B:
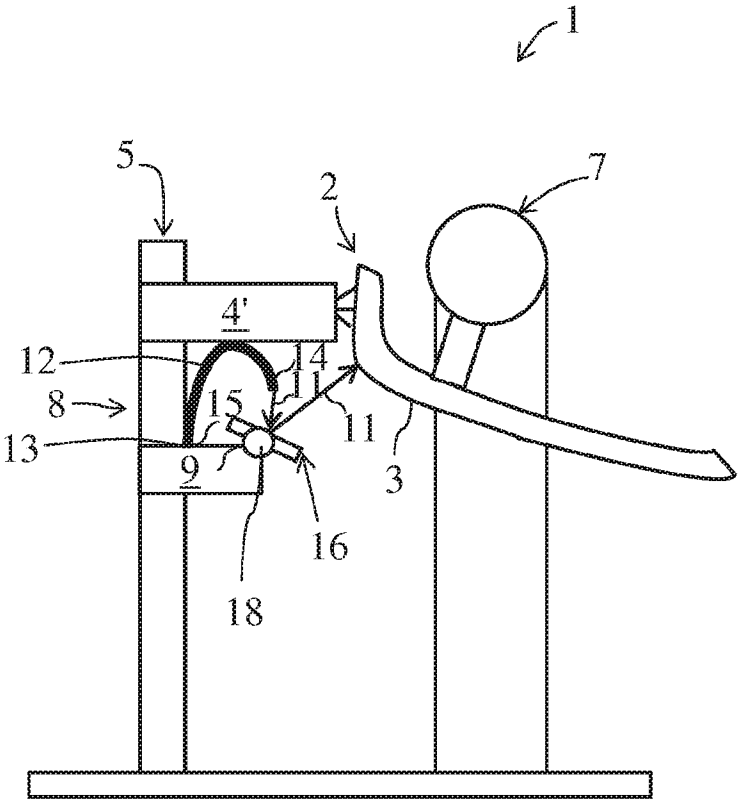
FIG. 3B is a partial schematic view of the installation in FIG. 3A during the displacement of the part.

When the deflection means 16 consist of a mirror as shown in FIGS. 3A and 3B, the output of the waveguide 14 may be positioned with respect to a reflective surface of the mirror and the beam 11 emanating from the exit of the waveguide 14 can be reflected by the mirror towards the surface 3 of the part 2. In this case, the emission output is formed by the beam 11 located downstream of the output of the waveguide 14 and before reflection on the mirror. In this case, the emission output does not match the location of a physical element, as is the case in the first and second variants.

A deflector 10 may further be mounted on the output of the waveguide 14 (FIG. 3C).

When the deflection means 16 comprise, alternatively, a prism, the latter can be arranged at the output of the waveguide 14 so that the prism is facing the surface 3 of the part 2. In this case, the emission output can be formed by the output of the waveguide 14.

According to the first, second and third embodiment variants of the invention, the waveguide 12, 12' may comprise at least one optical fiber 17.

The use of an optical fiber 17 makes it possible to easily guide the beam 11. In addition, the optical fiber 17 has the advantage of being space-saving and compact, which makes it possible to direct the beam 11 as close as possible to the part 2, which can have complex shapes. The optical fiber 17 also has the advantage of providing a directional beam 11 making it possible to ensure the perpendicularity between the emission output and the surface of the part 2.

According to a fourth embodiment variant of the invention, the source 9 of radiation may be rotatably mounted relative to the base 5 via means for adjusting the orientation of the beam 11, and means for adjusting the orientation of the beam 11 can be controlled by the control unit 6 to change the orientation of the beam 11 of the radiation source 9 with respect to the printed surface 3 (FIGS. 4A and 4B).

In this configuration, the means for adjusting the orientation of the beam 11 are specifically associated with the source 9. This arrangement advantageously allows the source 9 to be moved away from the printhead 4' which has the disadvantage of being bulky and of orienting the beam 11 emanating from the source 9 so that it reaches the surface 3 just to be printed and to be dried and to move only the source 9. The source 9 can thus be oriented independently of the printhead 4'.

In this case, the means for adjusting the orientation of the beam 11 may comprise at least one axis of rotation 18 which can be rotated by a predetermined angle 19 controlled by a servomotor controlled by the control unit 6.

Preferably, the angle 19 can be between 0 and 45 degrees. The angle 19 is 0 degrees when the beam 11 is substantially horizontal (FIG. 4A).

The orientation of the source 9 can thus be automated and controlled by the control unit 6.

According to this fourth embodiment variant, the source 9 can be fixed on the base 5 and be orientable relative to the base 5 by means of the axis of rotation 18 (FIG. 4A-4B).

According to the first, second, third and fourth embodiment variants of the invention, the source 9 of radiation can be controlled by the control unit 6 in particular to adjust the emission power of the source 9 of radiation.

It is thus possible to reduce the power of the source 9, if the distance d decreases (FIGS. 1A, 2A, 4A, 4A), and to increase the power of the source 9, when the distance increases (FIGS. 1B, 2B, 3B, 4B).

For example for a distance d=10 millimeters the power of the source may be equal to 5 Watt/centimeters2, for a distance d=20 millimeters the power of the source can be equal to 8 Watt/centimeters2, for a distance d=30 millimeters the power of the source can be equal to 10 Watt/centimeters2.

According to the fourth embodiment variant, this configuration advantageously makes it possible to adjust the power of the source 9 as a function of the distance d between the output of the source 15 forming the emission output and the surface 3 of the part 2. Indeed, according to this fourth embodiment variant, the distance d can vary during the movement of the part 2 preferably, between 10 and 50 millimeters. It is thus possible to reduce the power of the source 9, when the distance decreases (FIG. 4A), and to increase the power of the source 9, as the distance increases (FIG. 4B).

According to the first, second and third embodiment variants of the invention, the control unit 6 can be arranged to maintain a preset distance between the printed surface 3 of the part 2 and the emission output, preferably between 10 millimeters and 30 millimeters.

According to the invention, the method for printing and drying at least one device 1 comprising at least one printing surface 3 is characterized in that it implements the installation as described above and in that it comprises at least successively:

a printing step, in which: a liquid substance is deposited by the printhead 4' from printing means 4 on the surface 3 to be printed from the part 2 and the part 2 is moved in a controlled manner by the support device 7 in front of the printhead 4' to form a printed surface 3, and eventually, after lapsing of a determined time interval, a drying step, during which: the liquid substance deposited is reached by a beam 11 of rays emitted by the means for drying and/or controlled crosslinking 8 to be dried, the part 2 is moved by the support device 7, a preset distance d between the emission output of the means for drying and/or controlled crosslinking 8 and the printed surface 3 of the part 2 is maintained, preferably between 10 millimeters and 50 millimeters, and the beam 11 is oriented by the beam orientation adjusting means 11 specifically associated with the radiation source 9 and/or at least one emission output.

Preferably, the time interval can be between 0.0625 seconds and 0.125 seconds.

Preferably, during the drying step, at least one emission output mounted on an axis of rotation 18 forming the means for adjusting the orientation of the beam 11 can be oriented at a predetermined angle 19, for example between 0 degrees and 45 degrees and controlled by the control unit 6.

Preferably, during the drying step, deflection means 16 mounted on an axis of rotation 18 forming the means for adjusting the orientation of the beam 11 can be oriented at a predetermined angle 19, controlled by the control unit 6.

During the drying stage, the emission power of the source 9 can be adjusted by the control unit 6 according to the distance d between the emission output of the drying and/or crosslinking means 8 and the printed surface 3 of the part 2.

Of course, the invention is not limited to the embodiments described and shown in the accompanying drawings. Modifications are possible, especially from the point of view of the constitution of the various elements or by substitution of equivalent techniques, without departing from the scope of protection of the invention.

What is claimed is:

1. An installation for printing and drying of at least one part, comprising at least one surface to be printed, said installation comprising at least:

printing means comprising at least one printhead, of the inkjet type for depositing at least one liquid substance and forming a printed surface on said device, at least one base or a pedestal on which is mounted said at least one printhead, a control unit, a support device which is suitable and intended to support the at least one part, the support device and said at least one printhead being relatively mobile relative to each other, means of drying and/or controlled crosslinking comprising at least one radiation source and at least one emission output from which emanates at least one ray beam, said at least one emission output and said support device being relatively mobile relative to each other, the relative movements between the support device of said at least one part, on the one hand, and said at least one printhead and/or said at least one emission output of said controlled drying and/or crosslinking means, on the other hand, being preferably driven by the control unit, means for adjusting the orientation of the beam specifically associated with said at least one radiation source and/or said at least one emission output, wherein said at least one part is a piece of trim or upholstery for vehicle interiors and wherein the support device has a robotic multi-axis structure, is moveable under the control of the control unit with respect to said printhead which is fixed and at said emission output and is configured to maintain a preset distance (d), preferably between 10 millimeters and 30 millimeters, between the emission output of the drying and/or crosslinking means and the printed surface of the device.

2. The installation according to claim 1, wherein the radiation source is a source of light radiation generating at least one beam having wavelengths, preferably in their majority, in the ultraviolet field.

3. The installation according to claim 1 wherein the means for drying and/or controlled crosslinking comprise at least one optical waveguide comprising at least one input of the waveguide and at least one output of the waveguide, said input of the waveguide being coupled to an output of the radiation source, and said output of the waveguide or a deflector mounted on the output of the waveguide or a beam downstream from said output of the waveguide or the deflector forming said emission output of said drying and/or crosslinking means, and wherein a preset distance between the emission output and the printhead is preferably between 30 and 100 millimeters.

4. The installation according to claim 3, wherein the means for drying and/or controlled crosslinking comprise a single waveguide and wherein the means for adjusting the orientation of the beam comprises an axis of rotation orientable according to a predetermined angle controlled by the control unit specifically associated with the emission output.

5. The installation according to claim 3, wherein the means for drying and/or controlled crosslinking comprises a plurality of waveguides and wherein the means for adjusting the orientation of the beam comprise a plurality of rotation axes pre-oriented at an angle specifically associated with the emission outputs.

6. The installation according to claim 3, wherein the means for drying and/or controlled crosslinking include only one waveguide and wherein the means for adjusting the orientation of the beam comprise deflection means of the beam which are disposed downstream or after the output of the waveguide to orient the ray beam at a predetermined angle.

7. The installation according to claim 6, wherein the deflection means are rotatably mounted on an axis of rotation driven by the control unit.

8. The installation according to claim 6, wherein the deflection means can be selected from at least one prism or at least a mirror or at least one semi-reflective element.

9. The installation according to claim 3, wherein the waveguide comprises at least one optical fiber.

10. The installation according to claim 1, wherein the radiation source is rotatably mounted relative to the base via means for adjusting the orientation of the beam, and in that said means for adjusting the orientation of the beam are controlled by the control unit to change the orientation of the beam of the radiation source relative to the printed surface.

11. The installation according to claim 10, wherein the means for adjusting the orientation of the beam comprise at least one axis of rotation rotatable at a predetermined angle controlled by a servomotor controlled by the control unit.

12. The installation according to claim 1, wherein the radiation source is controlled by the control unit in particular for adjusting the emission power of the radiation source.

13. The installation according to claim 1 wherein the control unit is arranged to maintain a preset distance (d) between the printed surface of the part and the emission output, preferably between 10 millimeters and 30 millimeters.

14. A method for printing and drying at least one part, comprising at least one surface to be printed, said method comprising at least successively:

a printing step including: depositing a liquid substance by a printhead belonging to a printing means on a surface to be printed of the part and moving the part in a controlled manner by a support device in front of the printhead to form a printed surface, and a drying step including drying the deposited liquid substance by reaching the liquid substance by a beam of rays emitted by a means for drying and/or controlled crosslinking, and orienting the beam by a means for adjusting the orientation of the beam specifically associated with the radiation source and/or at least one emission output, implementing an installation according to claim 1, wherein the part is a piece of trim or upholstery for vehicle interiors, wherein the drying of the deposited liquid substance is carried out as close as possible to the part and immediately after depositing the liquid substance by the printhead, and, wherein, during the drying step:

the part is moved by the support device having a robotic multi-axis structure, a pre-set distance (d) between the emission output of the means for drying means and/or controlled crosslinking and the printed surface of the part is maintained preferably between 10 millimeters and 50 millimeters.

15. The method according to claim 14, wherein during the drying step, at least one emission output mounted on an axis of rotation forming the means for adjusting the orientation of the beam is oriented at a predetermined angle controlled by the control unit.

16. The method according to claim 14, wherein during the drying step, deflection means mounted on an axis of rotation, forming said means for adjusting the orientation of the beam, are oriented at a predetermined angle, controlled by the control unit.

17. The method according to claim 14, wherein during the drying step, the emission power of the radiation source is adjusted by the control unit according to the distance (d) separating the emission output of the means for drying and/or crosslinking and the printed surface of the part.

* * * * *